US006862767B2

(12) United States Patent
Runyon

(10) Patent No.: US 6,862,767 B2
(45) Date of Patent: Mar. 8, 2005

(54) METHOD FOR DRY CLEANING WITH BINARY VAPOR

(76) Inventor: Ronnell R. Runyon, 2037 Oxford St., Sacramento, CA (US) 95815

( * ) Notice: Subject to any disclaimer, the term of this patent is extended or adjusted under 35 U.S.C. 154(b) by 147 days.

(21) Appl. No.: 10/074,467

(22) Filed: Oct. 25, 2001

(65) Prior Publication Data

US 2003/0079298 A1 May 1, 2003

(51) Int. Cl.[7] ..... D06F 43/08
(52) U.S. Cl. ..... 8/158; 8/142; 8/149.3
(58) Field of Search ..... 8/142, 147, 149.1, 8/149.3, 158, 159, DIG. 1; 68/12.08, 18 R, 18 C, 18 F; 134/36, 37, 40, 100.1, 102.1, 102.2

(56) References Cited

U.S. PATENT DOCUMENTS 5,114,495 A * 5/1992 Mainz ..... 134/11
5,120,370 A * 6/1992 Mori et al. ..... 134/22.15
5,888,250 A * 3/1999 Hayday et al. ..... 8/142
6,691,536 B2 * 2/2004 Severns et al. ..... 68/12.27

* cited by examiner

*Primary Examiner*—Frankie L. Stinson
*Assistant Examiner*—Joseph Perrin
(74) *Attorney, Agent, or Firm*—Herbert C. Schulze

(57) ABSTRACT

The invention is a method for dry cleaning with binary vapor in which articles such as fabrics and the like are subjected to tumbling in a basket or chamber while heated air is circulated through said chamber. While being tumbled, the articles are exposed to binary vapor consisting of water and solvent under pressure which loosens or removes debris and soils from the articles. The debris and soils are carried by the air and binary vapor to a filter where the soils and debris are captured with the binary vapor continuing on to a condenser where the binary vapor is converted to binary liquid. Upon conclusion of the cycle the articles are removed from the chamber.

1 Claim, 1 Drawing Sheet

METHOD FOR DRY CLEANING WITH BINARY VAPOR

CROSS REFERENCE TO RELATED PATENT APPLICATIONS

This patent application is related to application Ser. No. 10/053851, filed Oct. 25, 2001, of which I am a co-inventor.

BACKGROUND OF THE INVENTION

I. Field of the Invention

This invention is in the general field of cleaning methods and apparatus.

The invention is more particularly in the field of dry cleaning of fabrics, clothing, draperies, bedding and the like.

The invention is most particularly, but not exclusively, directed to the field of a dry cleaning business model algorithm utilizing, among other things, unique algorithm steps involving what I refer to as Binary Vapor.

II. Description of the Prior Art

The prior art g to vapor dry cleaning is best disclosed in U.S. Pat. Nos. 5,741,367; 5,716,456; 5,773,403; 5,503,681; 5,702,535; 5,945,016; 5,865,198; 5,834,416; 5,824,632; 5,492,647; 5,501,811; 5,224,495; 5,940,988.

I have examined all of the listed patents and many others as well. I am very familiar with operating dry cleaning facilities, literature and commercial bulletins, and available dry cleaning machinery and equipment.

None of the above listed patents and nothing else I could find disclosed or anticipated what I eventually conceived and developed, and which is disclosed in this patent application. Thus I believe it is accurate to say there is no prior art as to my Binary Vapor Dry Cleaning Business Model Algorithm.

SUMMARY OF THE INVENTION

In various jurisdictions there are many laws related to the use of various dry cleaning solvents. These laws are in a state of flux and new restrictions are being imposed frequently. The new laws and regulations in the dry cleaning industry make it very important to develop new techniques and equipment in order to utilize new classes of solvents for dry cleaning.

The most widely used solvents for dry cleaning have been perchloroethylene (commonly known as, and referred to herein as "perc" and petroleum based solvents, herein "pet").

There are primarily two basic dry cleaning systems known as "open" and "closed" systems.

The open systems utilize solvent vapor, ultrasonic solvent cleaning, and solvent dipping and spraying systems. The open systems contaminate the environment and are costly since much solvent cannot be recovered for reuse. Additionally the open systems can cause explosions and fires.

Closed dry cleaning systems attempt to address some of the problems of open systems. They maintain an airtight seal in the cleaning chamber while the solvent is being used. Perc and pet solvents are widely used in closed systems, particularly for cleaning clothing and the lie.

A major problem in dry cleaning with solvents is the production of hazardous waste. The liquid waste must be picked up at the dry cleaning facility by licensed hazard waste disposal companies. This is costly. Not only solvent waste, but also water waste must be handled in this manner.

Dry cleaning establishments are highly regulated, especially in multi-tenant buildings. They are required to meet strict rules of the National Fire Protection Association, EPA, DEP, OSHA, Department of Health, and Fire Departments. Inspections are made regularly, and the inspectors may order a dry cleaner to close on finding a failure to meet the strict regulations. Additionally, each dry cleaner must maintain extensive records of operational procedures and must make weekly self inspections. There are numerous other problems such as complaints from neighbors, refusal of landlords to lease preferred locations, refusal to renew leases because of complains, and the like.

Currently, in closed systems the procedure is generally that a cleaning operator will spot clean (applying special chemicals to particular stains on articles), load the article into a dry cleaning machine, and activate the cleaning process.

Typically the cleaning process consists of loading a basket (a perforated drum or the like) with the articles to be cleaned; filling the machine with solvent, constantly pumping the solvent into the basket and filtering the solvent frequently while the articles being cleaned are tumbled in the basket; centrifuging the articles in the cleaning basket to remove the bulk of the solvent which is pumped away. Thereafter the articles in the basket are tumbled in circulating heated air which vaporizes and removes the remaining solvent and any water and soil waste. The solvent is then distilled and reclaimed.

Some articles cannot be cleaned by solvents and they are "wet cleaned" which is essentially using water and special soaps in an ordinary washing machine and drying in a customary dryer. Only a portion of the articles received by a dry cleaner can be wet cleaned because of various problems such as shrinkage, color bleeding, wrinkling and the like. Also, wet cleaning is very time consuming and labor intensive.

Articles cleaned by the existing methods are saturated by the solvent or water and are agitated to remove the soils. This results in adversely affecting the integrity of fabrics and the like.

I have studied dry cleaning and dry cleaning machinery, dry cleaning methods, and dry cleaning solvents for a long period of time. I have now developed a complete business model algorithm utilizing certain non-perc or pet solvents, equipment, and techniques which do not have the problems associated with perc and pet solvents but which have not been practical with existing dry cleaning procedures. My algorithm is based on a novel, unique, and useful use of water/solvent binary vapor cleaning which can be performed in conventional dry cleaning apparatus or a recovery dryer using environmentally safe solvents with flash-points over 100° F.

It is an object of this invention to provide a business model algorithm for dry cleaning of a variety of articles made from fabrics, leathers, furs, and the like utilizing novel, unique, and useful water/solvent binary vapor as the cleaning agent;

Another object of this invention is to provide a means for dry cleaning articles using circulating water/solvent vapors to "lift" and transfer debris and soil from the articles to a filter;

Another object of this invention is to provide a means for adapting existing dry cleaning machinery to operate within all building and safety code requirements according to my new algorithm;

Another object of this invention is to generate a water/solvent binary vapor under controlled variable temperature and ratio;

Another object of this invention is to provide an algorithm for dry cleaning which reduces the time required to dry clean articles; Another object of this invention is to provide a means for dry cleaning fabrics in a manner which reduces the damage to the fabrics which has occurred in the dry cleaning processes heretofore known;

Another object of this invention is to provide a closed loop binary vapor system of dry Cleaning with filtration of removed debris and soils and recovery of the binary vapors;

Another object of this invention is to treat articles being dry cleaned with a compatible binary vapor detergent and/or finishing chemical during cleaning;

Another object of this invention is to treat articles being dry cleaned with a semi-dry detergent foam to enhance debris and soil removal;

Another object of this invention is to provide a means for separating the two components of a binary vapor for recovery as independent substances.

The foregoing and other objects and advantages of this invention will become apparent to those skilled in the art upon reading the description of preferred embodiments, which follows, in conjunction with a review of the appended drawings.

DESCRIPTION OF A PREFERRED EMBODIMENT

Figure 1:
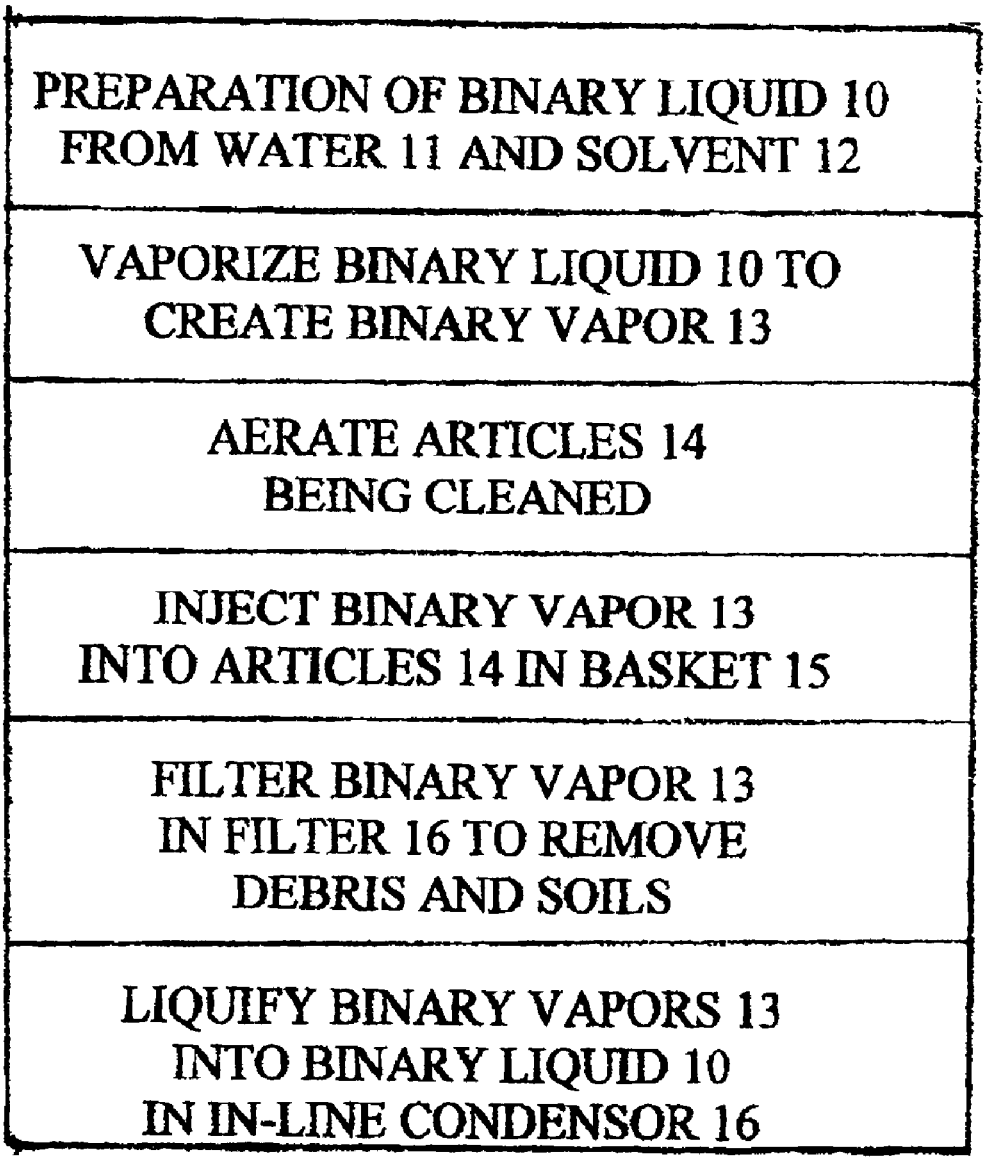
FIG. 1 is a diagram of steps of a complete Binary Vapor Dry Cleaning Business Model Algorithm

An inventory of items bearing reference numerals on the drawings is:

| Numeral | Item |
|---|---|
| 10 | binary liquid |
| 11 | water |
| 12 | solvent |
| 13 | binary vapor |
| 14 | articles |
| 15 | basket |
| 16 | in-line condenser |

Most solvents will exhibit some degree of uniform activity with water. For use in my new dry cleaning business many solvents can be used successfully. The mixture of water and solvent and its vaporization can be easily accomplished either by vaporizing the mixture or by vaporizing the components and mixing the vapors, such as by metering the two vapors in appropriate quantities into an injection nozzle or the like as will be understood by those skilled in the art.

Preferred solvents include dimethyl silicone fluids, glycol ethers, and alcoholic esters. The dimethyl silicones (organosilicones) are either straight-chain or cyclic. Lower molecular weight straight-chain organosilicones may show little miscibility with water, their cyclic counter part (cyclic siloxanes—octamethyltetracyclosiloxane {tetramer}, decamethylpentacyclosiloxane {pentamer}, and dodecamethylhexacyclosiloxane {heximer}) do exhibit variable binary ratios with water. The importance of the binary vapor is that it remains consistent over a temperature range from 210° F.(where it is generated) down to 130° F. (where it is applied).

The tetramer produces a binary vapor which is 33% water and 67% tetramer at 205° F. The pentamer produces a binary vapor which is 60% water and 40% pentamer at 208° F. The heximer produces a binary vapor which is 85% water and 15% heximer at 210° F. These ratios are variable by changing temperatures at which they are generated. All ofthese have flashpoints above 200° F. which is very important because of equipment/solvent fire regulations.

It is important that the binary vapor separate into its components after it is condensed into a liquid so that the solvent not remain miscible with the water.

The cyclic siloxane binary vapor mixtures have the unique, novel and useful feature of being able to wet both water and oil based stains and soils. Fatty acids generated by the human body attach to the to the surface of clothing as well as water-based stains. In the processes heretofore known the clothing fibers are immersed in the solvent and/or water and mechanically agitated to attempt to remove the wet fatty acids and water soils from the fibers. The fiber which was originally dyed in a similar process may now lose color in the described cleaning process.

In my new process, the binary vapor only wets the surface of the fabric fiber and the soils to be removed. The injection of the binary vapors into the tumbling articles in a conventional dry cleaning machine causes the agitation necessary to remove the soils from the article. The removed debris and the like is then carried by the circulating air stream to, and captured by, a filter through which the vapors pass. The vapors then enter a condenser where they are returned to liquid. Later the liquid will once again be vaporized The de-vapored air circulates to a heating means and is then reintroduced into the basket where the articles are tumbling. The entire cycle can be completed in the remarkably short time of five to twenty minutes.

My new method of cleaning is superior for all articles and is particularly valuable for dense materials such as leather where generally only surface cleaning is required.

The straightforward basic operation of my algorithm is: binary liquid 10 is prepared by mixing water 11 and solvent 12. The binary liquid 10 is vaporized in a manner described below. And is now binary vapor 13. In some cases the water and solvent will be vaporized before being mixed. Next, the articles being cleaned are aerated 14 in a cleaning basket 15 or the like. The binary vapor is injected under pressure into the articles being tumbled in the cleaning basket. The binary vapor carrying debris and soils (debris and soils are defined as any material which has stained or otherwise affected the surfaces or body of the articles being dry cleaned) passes to a filter where the debris and soils are removed. The binary vapor minus the debris and soils passes to a condenser 16 where the binary vapor is returned to binary liquid.

The binary vapor for my new dry cleaning process can easily be generated in many conventional dry cleaning machines. Many such conventional machines have an atmospheric still which is used to purify the solvent. These existing stills generate temperatures approaching 230° F. which is more than sufficient to generate the solvent/water binary vapor under 212° F. Introducing air pressure into the still provides the means to provide pressurized vapor which is than carried to the cleaning basket where it can be introduced to the articles being cleaned continuously or in pulses. This will be understood by those skilled in the art.

Another way to produce the solvent/water binary vapor is by using low pressure saturated steam In this method, the solvent is maintained at a constant level in a heating vessel Steam from an outside source enters the vessel at a controlled rate, thus a binary vapor is generated which is directed under pressure to the cleaning basket by means known to those skilled in the art.

Still another way in which the pressurized binary vapor can be generated is by using a conventional steam cleaning apparatus. The solvent/water liquid is introduced into the heating chamber of the steam cleaning apparatus at a suitable pressure (for example 200 psi) which will allow for an exit nozzle pressure within 10% of the entry pressure.

Another important aspect of this invention is that a detergent foam can be introduced into the basket after the articles begin to tumble. This will provide surface wetting/activation of soils on the fibers which allows the soils to be easily blown off by the binary vapor, or even by steam or pressurized air or other fluids.

If the atmospheric air in a heating chamber where binary vapor is generated is replaced by an inert fluid such as nitrogen or carbon dioxide I have found a remarkable increase in the effectiveness of removal of various spots on articles being dry cleaned.

The binary vapors can be used to carry various finishing chemicals to the surfaces of articles being cleaned. Sizing, softeners, bleaches, deodorizers and the like can be advantageously applied in this manner.

In all manners in which the binary vapor may be generated, the pressurized vapor can be introduced into the cleaning basket continuously or in pulses, as will be clear to those skilled in the art.

In the claims which follow if I should fail to claim a patentable feature such failure to claim will be due to inadvertence or oversight and is not to be interpreted as an intent to dedicate or abandon such feature.

While the embodiments of my inventions shown and described are fully capable of achieving the objects and advantages desired, such embodiments have been shown for purposes of illustration only and not for purposes of limitation.

I claim:

1. A method for dry cleaning with binary vapor comprising the steps of: placing articles to be dry cleaned in a cleaning chamber having means to tumble the articles; tumbling the articles in the chamber; circulating a first gaseous fluid into said chamber and articles and out of said chamber; formulating a second fluid which is a binary vapor comprised of vaporized water and solvent; pressurizing said binary vapor, introducing said binary vapor under pressure into said chamber and onto said articles while tumbling and being exposed to said first gaseous fluid and removing debris and soils from the articles and suspending such debris and soils in the circulating mixture of said first gaseous fluid and the binary vapor, transporting said mixture of the first gaseous fluid and said binary fluid with debris and soils to a filter; filtering debris and soils from the mixture; condensing the binary vapor into a binary fluid; and removing said articles from said chamber.

* * * * *